US006328493B1

(12) United States Patent
Starchevich

(10) Patent No.: US 6,328,493 B1
(45) Date of Patent: Dec. 11, 2001

(54) INSTRUMENTS WITH ERGONOMIC GRIPPING

(76) Inventor: Jovanka Starchevich, 138 Sullivan St., New York, NY (US) 10012

( * ) Notice: Subject to any disclaimer, the term of this patent is extended or adjusted under 35 U.S.C. 154(b) by 0 days.

(21) Appl. No.: 09/282,761

(22) Filed: Mar. 31, 1999

(51) Int. Cl.[7] ..... A46B 5/02
(52) U.S. Cl. ..... 401/6; 40/334
(58) Field of Search ..... 401/6; 40/334; 1/905; D19/55; 15/425, 437, 443; 16/430; 606/167; 81/489, 490, 491, 492

(56) References Cited

U.S. PATENT DOCUMENTS

| | | | | |
|---|---|---|---|---|
| D. 359,508 | * | 6/1995 | Debbas | D19/47 |
| 586,143 | * | 7/1897 | North | 401/250 |
| 1,291,972 | * | 1/1919 | McGuigan | 401/6 |
| 1,678,505 | * | 7/1928 | Gregory | 401/82 |
| 3,994,605 | * | 11/1976 | McKnight | 401/99 |
| 4,037,975 | * | 7/1977 | Huffman | 401/6 |
| 5,391,010 | * | 2/1995 | Gorbunov | 401/8 |
| 5,590,971 | * | 1/1997 | Melnick | 401/202 |

FOREIGN PATENT DOCUMENTS

| | | | | |
|---|---|---|---|---|
| 03292200A | * | 12/1991 | (JP) | 401/6 |

OTHER PUBLICATIONS

Advertisement for an ergonomic pen, Dec. 1998.*

* cited by examiner

*Primary Examiner*—David J. Walczak
*Assistant Examiner*—Peter deVore
(74) *Attorney, Agent, or Firm*—Howard C. Miskin; Gloria Tsui-Yip

(57) ABSTRACT

An instrument having ergonomic gripping for the comfort and firm gripping by a user. The instrument comprises an elongated body having a uniform rear portion that diverges into two or more arms, which are then merged at the front writing end to form a bulbous front portion for a user to grip. In one embodiment, the two arms diverge from the rear portion defining an opening therebetween wherein a user's thumb is placed against one side of the opening and the middle finger against the opposite side of the opening, with the index finger resting along the curved bulbous front portion for a firm, ergonomic grip. In another embodiment, the instrument comprises a generally teardrop shaped annular body defining an opening therebetween having a concave surface and an opposite convex surface wherein a user's thumb is placed against the opening on the concave surface and the middle finger against the opening on the convex surface, with the index finger resting along the curved teardrop periphery. Additional ergonomic gripping is provided by filling the opening with a soft or heat-conforming material to further cushion the contact of the instrument with the user.

27 Claims, 5 Drawing Sheets

INSTRUMENTS WITH ERGONOMIC GRIPPING

FIELD OF THE INVENTION

The invention relates to instruments having an ergonomic configuration for the gripping and comfort of a user's thumb and fingers; in particular, hand-held instruments, such as writing instruments. In addition, such ergonomic configuration allows a compact design that readily allows the instrument, such as a writing instrument, to fit into a pocket or small bag or serve as a key chain.

BACKGROUND OF THE INVENTION

Ergonomics is a field of study on the relationship between people and their working environment. Numerous type of ergonomically compatible products are directed to the comfort and well-being of different portions of a user's body.

Writing instruments have been ergonomically designed to allow a firm gripping and to alleviate the pressure exerted upon the gripping fingers to minimize calluses or fatigue. An ergonomic writing instrument also facilitates its handling by children, senior citizens who may suffer from arthritis or people with handicap.

There are generally two categories of prior art ergonomic writing instruments. The first type of prior art ergonomic writing instruments deviate from the structure of traditional cylindrical writing instruments. For example, U.S. Patent No. 5,564,849 to Joseph M. Greer, Jr. discloses a curved ergonomic pen that facilitates writing on both vertical and horizontal surfaces and U.S. Pat. No. 5,332,324 to Michael A. Hochstetler, which discloses an ergonomic instrument having along its length a spiral groove. A disadvantage of this first type of prior art ergonomic writing instrument results from the deviation from the traditional cylindrical structure because a user must adjust and adapt to gripping the non-uniform structure.

The second type of prior art ergonomic writing instruments include a foam or rubber cushioning placed over the traditional cylindrical structure at the position where the user's thumb and fingers grip. U.S. Pat. No. 5,056,945 to Gerald J. Klodt illustrates one such cushioning grip for writing instruments. A limitation on this second type of prior art ergonomic writing instruments is that the comfort of the user cannot be fully ergonomically realized by the mere addition of a tubular cushioning over the underlying cylindrical structure of the writing instruments.

Therefore, there is a need for an instrument that is ergonomically designed for the comfortable gripping by the user in the natural positioning of the user's thumb and fingers.

SUMMARY OF THE INVENTION

The invention provides an instrument that is ergonomically designed for the comfortable gripping by a user.

The instrument of the present invention, in particular, relates to a writing instrument having an ergonomic configuration for the firm gripping and comfort of the user's thumb and fingers.

The writing instrument of the present invention comprises an axially elongated body having a uniform rear portion that diverges into two arms to form a bulbous front portion along a plane parallel to the axis of the elongated body. The two arms are then merged at the front writing end, forming a loop opening at the front portion of the writing instrument. The loop at the front portion of the writing instrument allows a user to position the pad of his/her thumb against one side of the loop opening and the side of his/her middle finger against the opposite loop opening, with the index finger resting along the curvature of the bulbous front portion. The loop opening and the bulbous front portion provide an enlarged area to facilitate gripping and additional comfort of a user's thumb and fingers over conventional writing instruments.

In an alternative embodiment of the present invention, the two arms are helically twisted prior to merging at the front writing end, advantageously allowing a user's thumb to be positioned against the opening of the helical bulbous portion for additional gripping comfort and stability.

In another alternative embodiment of the present invention, the uniform rear portion of the elongated body diverge into three arms to form a triangular bulbous front portion. The three arms are then merged at the front writing end. The three openings formed between adjacent arms allow a user to position the pad of his/her thumb against the first opening, the pad of the index finger against the second opening and the side of the middle finger against the third opening, enhancing the gripping comfort and stability.

Another alternative embodiment of the present invention comprises a generally teardrop shaped annular body having a writing end adjacent to the generally pointed end of the body. One surface of the annular body is generally concave and the opposite surface generally convex. The curvature on the concave surface is more pronounced along an axis where a user would naturally positioned his/her thumb on a writing instrument. Similarly, advantageously a slightly concave channel on the convex surface is provided along an axis where a user would naturally positioned his/her middle finger on a writing instrument. The pad of a user's thumb is placed against the opening on the generally concave side of the body, the side of the middle finger against the opening against the generally convex side of the body, with the pad of the index finger resting along the curved periphery of the teardrop shaped body. An additional advantage of this teardrop shaped embodiment is its compactness and portability, making it a particularly attractive promotional item that readily fits into a pocket or pocketbook or serve as a key chain.

The elongated or teardrop shaped body of the writing instrument of the present invention may be covered with a soft material to cushion the contact with the thumb and fingers. Furthermore, the openings formed between the arms of the elongated body or the annular body may be filled with a soft or pressure- or heat-conforming gelatinous-like material for additional ergonomic fitting and comfort of the thumb and middle finger. In addition, as writing instruments are often given away as promotional items, the openings formed between the arms of the elongated body and the annular body provide the spacing for placing an indicia therebetween.

BRIEF DESCRIPTION OF THE DRAWINGS

These and other features of the invention are delineated in detail in the following description. In the drawings.

It will be appreciated that, for purposes of illustration, these figures are not necessarily drawn to scale.

DETAILED DESCRIPTION OF THE PREFERRED EMBODIMENTS

Figure 1:
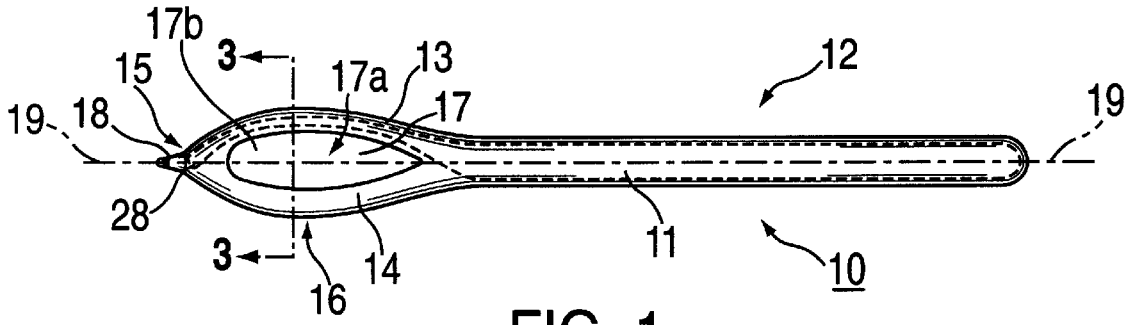
FIG. 1 is a front elevational view of the present invention having an elongated body with a pair of arms forming the bulbous front portion.

With reference to the drawings, wherein the same reference number indicates the same element throughout, there is shown in FIG. 1 a perspective view of one embodiment of the present invention. An instrument 10 is shown in FIG. 1 as a writing instrument, but other types of instruments, such as computer stylus or pointer, that are held in a fashion similar to writing instruments are contemplated.

As shown in FIG. 1, instrument 10 of the present invention comprises an axially elongated body 11 having a uniform rear portion 12 that diverges into two arms 13 and 14 that are then merged at the front end 15 of the instrument 10 to form a bulbous or enlarged streamlined front portion 16 having an opening 17 therein. Positioned at the front end 15 of instrument 10 is the writing end 18. The bulbous front portion 16 is formed along a plane parallel to an axis 19 of the elongated body 11. Arms 13 and 14 forming the bulbous front portion 16 extend equidistant and symmetrically from axis 19.

Figure 2:
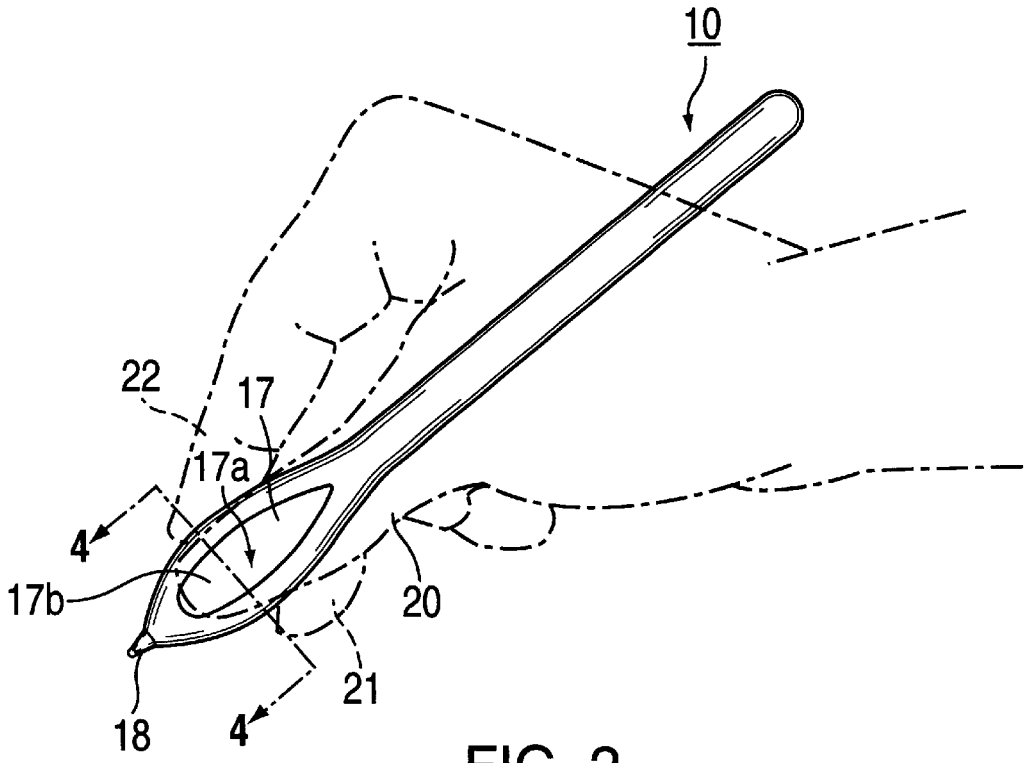
FIG. 2 is a front elevational view identical to FIG. 1, illustrating by broken line the ergonomic positioning of a user's thumb and index and middle fingers.

FIG. 2 illustrates the advantageous and ergonomic handling of instrument 10 by a user. The pad of the user's thumb 20 is placed over the first side 17*a* of opening 17 and the side of the middle finger 21 is placed over the opposite side 17*b* of opening 17, with the pad of the index finger 22 resting along the curvature of the bulbous front portion 16. The positioning as shown in FIG. 2 replicates the natural positioning of a user's thumb and fingers on conventional writing instruments, thereby allowing the user to grip the front portion 16 of instrument 10 with minimal effort while minimizing the movement of instrument 10 in the user's hand.

Figure 6:
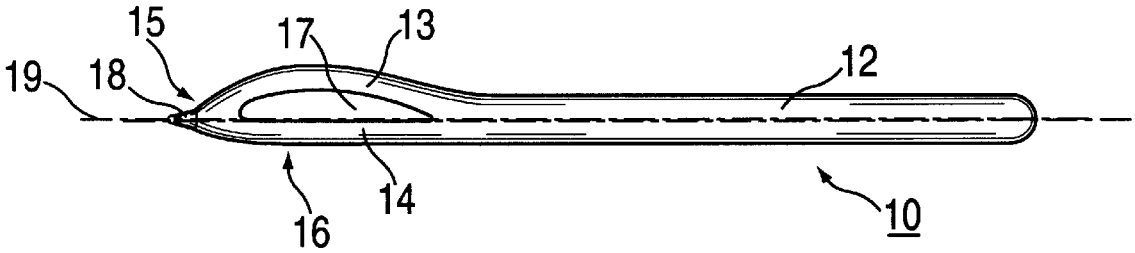
FIG. 6 is a front elevational view of an alternative embodiment of the present invention having an elongated body with a pair of arms forming an asymmetrical bulbous front portion.

A second embodiment of the present invention is shown in FIG. 6, with arms 13 and 14 of instrument 10 diverging from the rear portion 12 to form an asymmetrical bulbous front portion 16 wherein arm 14 remains substantially parallel to axis 19. Identical to the first embodiment shown in FIG. 1, the bulbous front portion 16 is formed along a plane parallel to an axis 19 of the elongated body and at the front end 15 where arms 13 and 14 merge is the writing end 18. This second embodiment provides a smaller opening 17 and smaller bulbous front portion 16 than instrument 10 shown in FIG. 1 and could accommodate a user with slender thumb and fingers. Similarly, a small opening 17 can be achieved by reducing the distance arms 13 and 14 extend away from axis 19.

Figure 7:
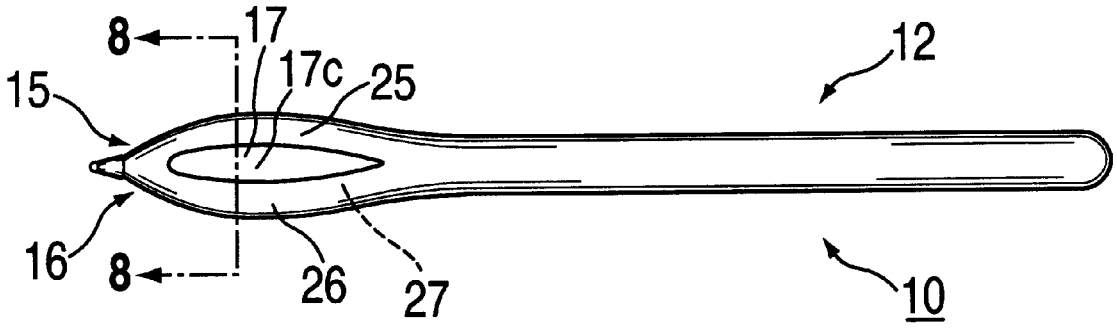
FIG. 7 is a front elevational view of another embodiment of the present invention having an elongated body with three arms forming the bulbous front portion.

FIG. 7 shows a third embodiment of the present invention with three arms 25, 26 and 27 diverging from the rear portion 12 of instrument 10 to form a triangular bulbous front portion 16. Arms 25, 26 and 27 merge at the front end 15 of instrument 10. Positioned at the front end 15 is the writing end 18. Arms 25, 26 and 27 forming the triangular bulbous front portion 16 extend equidistant from axis 19. Between each pair of arms 25–26, 26–27 and 25–27 are three openings 17*c*, 17*d* and 17*e*, respectively. The pad of a user's thumb 20 is placed over the first opening 17*c* and the side of the middle finger 21 is placed over the second opening 17*d*, similar to that shown in FIG. 2, with the pad of the index finger 22 placed over the third opening 17*e* (not shown).

Figure 10:
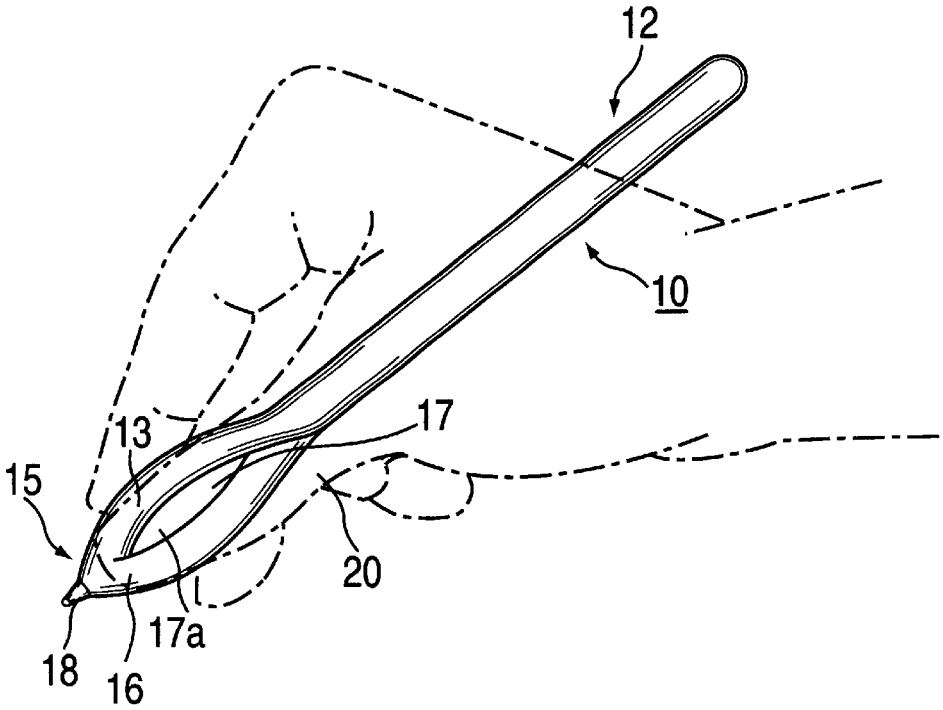
FIG. 10 is a front elevational view of another embodiment of the present invention having an elongated body with two arms helically twisted to form the bulbous front portion, with the broken line showing of a user's thumb to illustrate the ergonomic positioning.

FIG. 10 shows a fourth embodiment of the present invention being similar to the embodiment shown in FIG. 1, except that arms 13 and 14 diverging from the rear portion 12 are helically intertwined before merging at the front end 15 of instrument 10 to form a bulbous front portion 16 having an opening 17 therein. Positioned at the front end 15 is the writing end 18. It is preferable that arms 13 and 14 each helically rotates approximately one hundred and eighty degree (180°) such that when placed over the first side 17*a* of opening 17, a user's thumb 20 is aligned with the rotation of the helically intertwined arms 13 and 14 to provide additional gripping stability and comfort. Arms 13 and 14 rotate either clockwise or counter-clockwise to accommodate left- or right-handed users.

Figure 3:
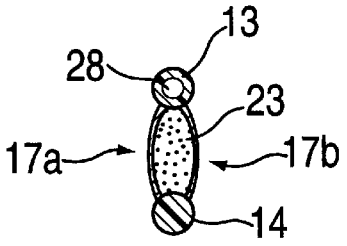
FIG. 3 is a cross-sectional view of FIG. 1 taken along the line 3—3, illustrating the gelatinous-like material filling the opening formed by the pair of arms.
Figure 4:
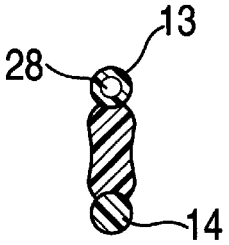
FIG. 4 is a cross-sectional view of FIG. 2 taken along line 4—4, illustrating the gelatinous-like material conforming to the user's thumb and index and middle fingers.
Figure 8:
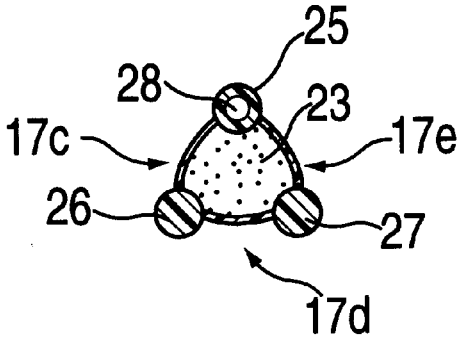
FIG. 8 is a cross-sectional view of FIG. 7 taken along the line 8—8, illustrating the gelatinous-like material filling the opening formed between adjacent arms.

For the embodiments shown in FIGS. 1, 6, 7 and 10, it is preferable that the rear portion 12 and the arms 13, 14, 25, 26 and 27 are cylindrical as shown in FIGS. 3 and 8 or any other shapes with no sharp edges, such as oval, such that instrument 10 rests comfortably against the hand of the user (as shown in FIG. 2). Furthermore, the entire rear portion 12 and the arms 13, 14, 25, 26, and 27 can be covered with a soft material, such as rubber, silicone, foam, etc., to cushion the contact of the instrument 10 against the user's hand. Additional comfort can be achieved by filling the openings 17*a*, 17*b*, 17*c*, 17*d* and 17*e* with a soft or pressure- or heat-conforming material 23, such as rubber, silicone or foam, such that it provides additional cushioning to the user's thumb 20 and fingers 21 and 22 when a user grips instrument 10 (see, e.g., FIG. 4).

As writing instruments, the embodiments shown in FIGS. 1, 6, 7 and 10 can accommodate ink and/or ink cartridge 28 along the length of one or more arms 13, 14, 25, 26 and 27 and rear portion 12, as illustrated in FIGS. 1 and 3. The type and placement of ink and/or ink cartridge 28 is known to one skilled in the art of writing instruments and is not described in detail herein. The construction of elongated body 11 of the embodiments shown in FIG. 1, 6, 7 and 10 can be manufactured by either a molding process or an extrusion process, known to one skilled in the art of manufacturing and is not described in detail herein. For the embodiment shown in FIG. 1, for example, two tubes forming arms 13 and 14 may be extruded as two spaced apart sections that are joined to form the rear portion 12 with the front end 15 similarly joined to form the bulbous front portion 16. Ink and/or ink cartridge 28 can then be inserted into body 11 along the length extending from the front end 15 through arm 13 and/or arm 14 and the rear portion 12.

Figure 5:
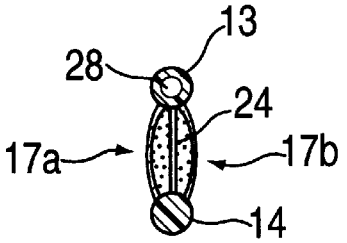
FIG. 5 is a cross-sectional view identical to FIG. 3, further illustrating the positioning of an insert between the gelatinous-like material for placement of an indicia.
Figure 9:
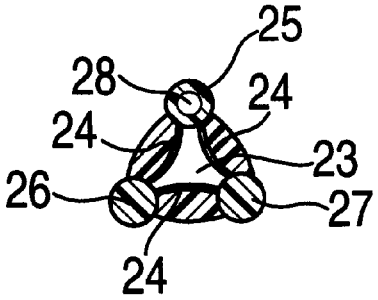
FIG. 9 is a cross-sectional view identical to FIG. 8, further illustrating the positioning of inserts between the gelatinous-like material for placement of indicia.

As writing instruments are often given away as promotional items, each opening 17*a*, 17*b*, 17*c*, 17*d* and 17*e* of instrument 10 also provide a space for placing a panel 24 therebetween for an indicia or logo as shown in FIGS. 5 and 9.

Figure 11:
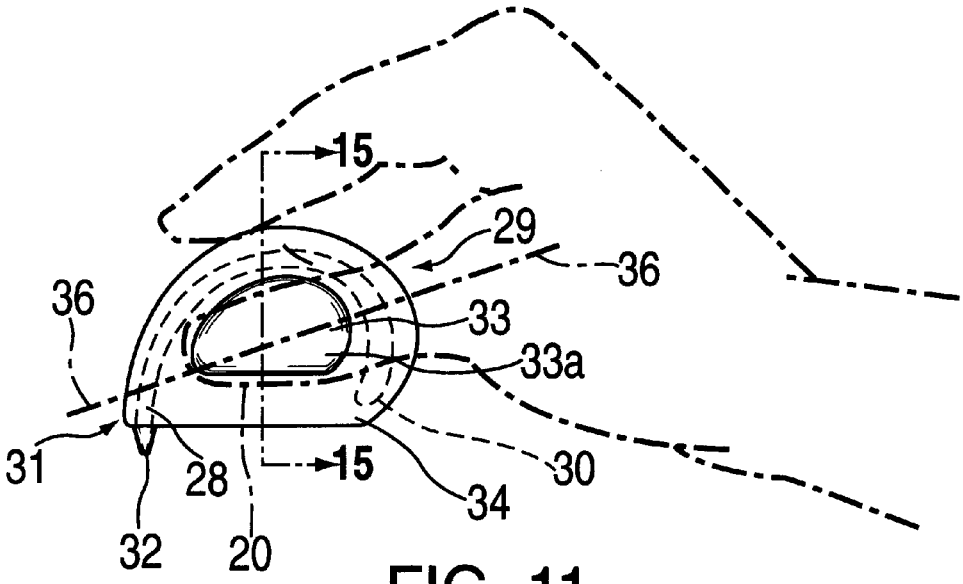
FIG. 11 is a front elevational view of another embodiment of the present invention having a teardrop shaped annular body, with the broken line showing of a user's thumb to illustrate the ergonomic positioning.
Figure 12:
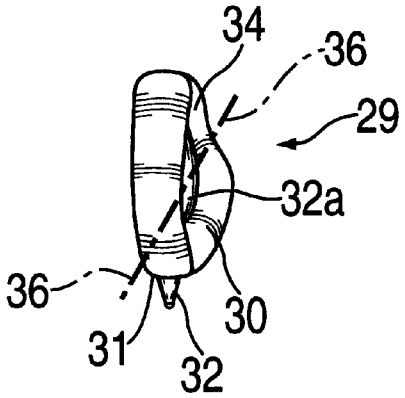
FIG. 12 is a left side view of FIG. 11, illustrating the concave surface with the curvature being more pronounced along an axis where a user would naturally positioned his/her thumb.
Figure 13:
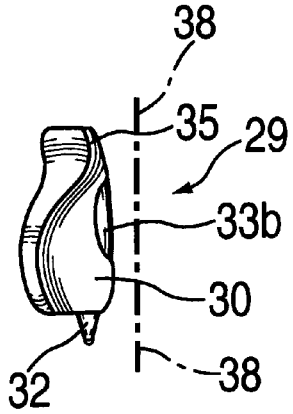
FIG. 13 is a right side view FIG. 11, illustrating the convex surface.
Figure 15:
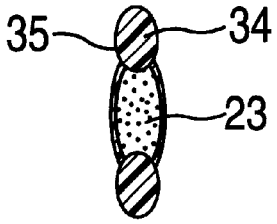
FIG. 15 is a cross-sectional view of FIG. 11, taken along the line 15—15, illustrating the gelatinous-like material filling the opening formed between the annular body.
Figure 14:
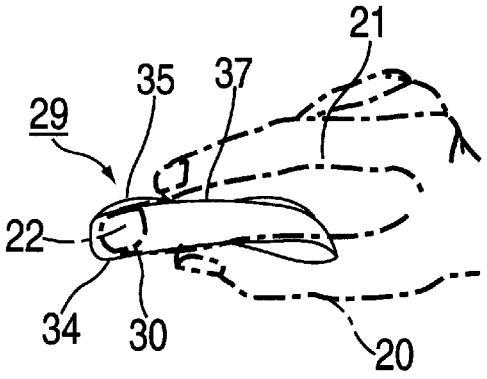
FIG. 14 is a top plan view of FIG. 11, illustrating by broken line the ergonomic positioning of a user's thumb and index and middle fingers and the slightly concave channel along an axis where a user would naturally positioned his/her middle finger.

A fifth embodiment of the instrument 29 of the present invention as shown in FIG. 11 comprises a generally teardrop shaped annular body 30. However, other generally curved shapes, such as a heart-shape or a free forming shape with an opening therebetween may be substituted without detracting from this embodiment. Adjacent to the pointed end 31 of the teardrop shaped body 30 is the writing end 32. Annular body 30 defines an opening 33. One surface 34 of the annular body 30 is generally concave and the opposite surface 35 is generally convex. The curvature of the concave surface 34 is more pronounced along an axis 36 where a user naturally positions his/her thumb 20 on instrument 29, as shown in FIGS. 11 and 12. Similarly, a concave channel 37 is provided on the convex surface 35 along an axis 38 where a user naturally positions his/her middle finger 22 against the convex surface 35 as shown in FIGS. 13 and 14. The ergonomic handling of instrument 29 can be appreciated when a user placed the pad of his/her thumb 20 against the first side 33*a* of opening 33 along axis 36 and the side of the middle finger 21 against the opposite side 33*b* of opening 33 along axis 38 with the pad of the index finger 22 resting along the curved periphery of the teardrop shaped body 30. Instrument 29 as shown in FIGS. 11–14 accommodates a right-handed user. However, a mirror image of the instrument 29 that can accommodate a left-handed user is contemplated and not separately described.

For the embodiment shown in FIG. 11, it is preferable that annular body 30 has no sharp edges such that instrument 10 rests comfortably against the user's thumb 20 and fingers 21 and 22 (as shown in FIG. 14). Furthermore, the entire annular body 30 can be covered with a soft material, such as rubber, silicone, foam, etc., to cushion the contact of the instrument 10 against the user's thumb 20 and fingers 21 and 22. Additional comfort can be achieved by filling the opening 33 with a soft or pressure- or heat-conforming material 23, such as rubber, silicone or foam, such that it provides additional cushioning to the user's thumb 20 and middle finger 21 when a user grips instrument 29 (see, e.g., FIGS. 11 and 14). As writing instruments are often given away as promotional items, opening 33 of instrument 29 also provide a space for placing a panel therebetween for an indicia or logo (not shown) (see, e.g. FIG. 5).

As writing instrument, the embodiment shown in FIG. 11 can accommodate ink and/or ink cartridge 28 along the curvature of the annular body 30, as illustrated in FIG. 11. The type and placement of ink and/or ink cartridge 28 is known to one skilled in the art of writing instruments and is not described in detail herein. The construction of annular body 30 of the embodiment shown in FIG. 11 can be manufactured by a molding process known to one skilled in the art of manufacturing and is not described herein.

Figure 16:
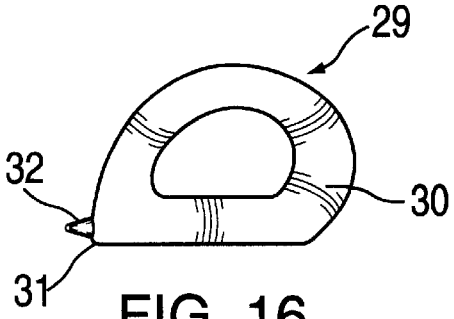
FIG. 16 is a front elevational view identical to FIG. 11, except for a different positioning of the writing end.

The writing end 32 of instrument 29 as shown in FIG. 11 is best for writing on a horizontal surface. By repositioning writing end 32 to the opposite side of the pointed end 31 of teardrop shaped body 30 as shown in FIG. 16, instrument 29 can be used to write on a vertical surface without detracting from the ergonomic handling of instrument 29.

Figure 17:
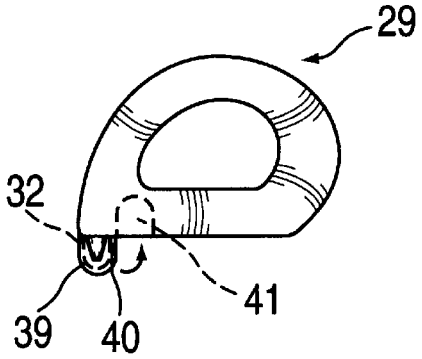
FIG. 17 is a front elevational view identical to FIG. 11, further illustrating a pivotable cover.
Figure 18:
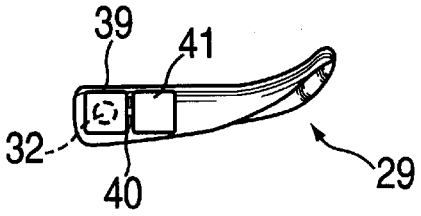
FIG. 18 is a bottom plan view of FIG. 17, illustrating a cavity for concealing the pivotable cover.

The compactness of writing instrument 29 advantageously increases its portability when compared to conventional elongated writing instruments. As shown in FIGS. 17 and 18, cover 39 protects the writing end 32 such that writing instrument 29 can safely fit into pockets and purses. Protective cover 39 pivotably mounted on a hinge 40 adjacent to writing end 32. Adjacent to hinge 40, opposite the writing end 32, is a cavity 41 in the annular body 30 which correspond to the cover 39 such that when cover 39 is pivoted open, cover 39 advantageously fit into cavity 41. Other pivotable means known to one skilled in the art, such as a living hinge, can be substituted to mount said protective cover on said body.

Although certain features of the invention have been illustrated and described herein, other modifications and changes will occur to those skilled in the art. It is, therefore, to be understood that the appended claims are intended to cover all such modification and changes that fall within the spirit of the invention.

What I claim is:

1. An instrument for ergonomic gripping by a user's thumb, index and middle fingers comprising an elongated body along an axis having a rear cylindrical portion with a uniform cross-section, a front bulbous ergonomic thumb, index and middle fingers gripping portion and a front end, said front bulbous portion comprises two or more cylindrical arms having opposite outside transverse surfaces connecting said front end to said rear portion to form said front bulbous portion, wherein the distance between said opposite outside transverse surfaces along a transverse axis of said front bulbous portion is greater than the diameter of said rear cylindrical portion along a transverse axis of said rear cylindrical portion.

2. The instrument according to claim 1 wherein said front end is a writing end.

3. The instrument according to claim 1 wherein said rear portion and said arms being covered with a soft material to cushion the contact of said instrument with said user's thumb, index and middle fingers.

4. The instrument according to claim 3 having first and second arms defining an opening therebetween at said front portion wherein said user's thumb being placed against a first side of said opening and the user's middle finger being placed against an opposite side of said opening with said user's index finger being rested on said bulbous front portion.

5. The instrument according to claim 4 wherein said opening being filled with a soft material to cushion the contact of said instrument with said user's thumb, index and middle fingers.

6. The instrument according to claim 5 wherein said first and second arms diverge from said rear portion in a plane parallel to said axis of said elongated body.

7. The instrument according to claim 6 wherein said bulbous front portion being symmetrical along said axis with said first and second arms diverge equidistant from said axis of said elongated body.

8. The instrument according to claim 6 wherein said bulbous front portion being asymmetrical along said axis with said first arm being substantially parallel to said axis of said elongated body.

9. The instrument according to claim 5 wherein said first and second arms being helically intertwined before merging at said front end to form said bulbous front portion having said opening therein, each of said arm helically rotates approximately one hundred and eighty degrees such that when said user's thumb is being placed against said first side of said opening, said thumb is aligned with said rotation of said helically intertwined arms.

10. The instrument according to claim 4 wherein said opening being filled with a heat-conforming material to cushion the contact of said instrument with said user's thumb, index and middle fingers.

11. The instrument according to claim 4 wherein said opening being filled with a pressure-conforming material to cushion the contact of said instrument with said user's thumb, index and middle fingers.

12. The instrument according to claim 4 wherein a panel extends across said first and second arms covering said opening for the placement of an indicia thereon.

13. The instrument according to claim 3 having first, second and third arms defining three openings between each pair of said arms at said front portion wherein said user's thumb being placed against said first opening and the user's middle finger being placed against said second opening with said user's index finger being placed against said third opening.

14. The instrument according to claim 13 wherein each of said opening being filled with a soft material to cushion the contact of said instrument with said user's thumb, index and middle fingers.

15. The instrument according to claim 13 wherein said opening being filled with a heat-conforming material to cushion the contact of said instrument with said user's thumb, index and middle fingers.

16. The instrument according to claim 13 wherein a panel for placement of an indicia thereon extends across each of said first and second arms, second and third arms and first and third arms, covering each of said opening.

17. An instrument for ergonomic gripping by a user's thumb, index and middle fingers comprising a generally teardrop shape body having a generally pointed end, an ergonomic thumb and middle finger gripping opening therethrough, a generally curved outer index finger gripping peripheral surface, a generally concave surface and an opposite surface wherein said ergonomic thumb and middle finger gripping opening traverse from said generally concave surface to said opposite surface such that said user's thumb being placed against said opening on said concave surface and said middle finger being placed against said opening on said opposite surface.

18. The instrument according to claim 17 wherein said user's thumb defines a first axis for its natural positioning and said user's middle finger defines a second axis for its natural positioning, wherein said concave surface having a first concave channel in alignment with said first axis of said thumb's natural positioning and said opposite surface having a second concave channel in alignment with said second axis of said middle finger's natural positioning such that said thumb rests along said first channel and said middle finger rests along said second channel for ergonomic gripping of said instrument.

19. The instrument according to claim 18 further comprising a writing end adjacent to said pointed end of said body along said teardrop periphery.

20. The instrument according to claim 19 further comprising a removable cover for protecting said writing end, said body further having a corresponding cavity adjacent to said writing end for concealing said cover, said cover being pivotably mounted on said teardrop periphery adjacent to said writing end such that said cover is concealed in said cavity when said cover is in an open position.

21. The instrument according to claim 20 wherein said body being covered with a soft material to cushion the contact of said instrument with said user's thumb, index and middle fingers.

22. The instrument according to claim 21 wherein said opening being filled with a soft material to cushion the contact of said instrument with said user's thumb, index and middle fingers.

23. The instrument according to claim 21 wherein said opening being filled with a heat-conforming material to cushion the contact of said instrument with said user's thumb, index and middle fingers.

24. The instrument according to claim 21 wherein said opening being filled with a pressure-conforming material to cushion the contact of said instrument with said user's thumb, index and middle fingers.

25. The instrument according to claim 21 wherein a panel extends across said opening for the placement of an indicia thereon.

26. An instrument for ergonomic gripping by a user's thumb, index and middle fingers comprising an elongated body along an axis having a rear portion with a uniform oval cross-section, a front bulbous ergonomic thumb, index and middle fingers gripping portion and a front end, said front bulbous portion comprises two or more arms having oval cross-sections having opposite outside transverse surfaces connecting said front end with said rear portion to form said front bulbous portion, wherein the distance between said opposite outside transverse surface along a transverse axis of said front bulbous portion is greater than the longitudinal distance along a transverse axis of said oval cross-section of said rear oval portion.

27. An instrument for ergonomic gripping by a user's thumb, index and middle fingers comprising an elongated body along an axis having a rear portion with a uniform cross-section, a front bulbous ergonomic thumb, index and middle fingers gripping portion and a front end, said front bulbous portion comprises two or more rigid spaced-apart arms having opposite outside transverse surfaces connecting said front end to said rear portion to form said front bulbous portion and defining a passageway between said arms, wherein the distance between said opposite outside transverse surfaces is greater than the longitudinal distance along a transverse axis of a cross section of said rear portion.

* * * * *